United States Patent [19]

Lamarca

[11] Patent Number: 4,594,825

[45] Date of Patent: Jun. 17, 1986

[54] CANTILEVERED SUPPORT MEMBER AND FOUNDATION UNIT

[76] Inventor: Guy M. Lamarca, 1928 Walton Ave., Pittsburgh, Pa. 15210

[21] Appl. No.: 695,165

[22] Filed: Jan. 25, 1985

Related U.S. Application Data

[63] Continuation-in-part of Ser. No. 283,568, Jul. 15, 1981, abandoned.

[51] Int. Cl.[4] ..... E02D 27/00

[52] U.S. Cl. ..... 52/169.4; 52/294; 405/284

[58] Field of Search ..... 52/169.4, 169.1, 169.6, 52/294; 405/284, 286

[56] References Cited

U.S. PATENT DOCUMENTS

| | | | |
|---|---|---|---|
| 921,545 | 5/1909 | Tudson | 405/284 |
| 936,843 | 10/1909 | Wood | 405/286 |
| 1,663,453 | 3/1928 | Coke-Hill | 405/286 |
| 1,778,574 | 10/1930 | Thornley | 405/286 |
| 2,039,260 | 4/1936 | Raner | 405/287 |
| 4,190,384 | 2/1980 | Neumann | 405/284 |

FOREIGN PATENT DOCUMENTS

| | | | |
|---|---|---|---|
| 604264 | 1/1935 | Fed. Rep. of Germany | 405/284 |
| 2463836 | 4/1981 | France | 405/286 |
| 78724 | 6/1980 | Japan | 405/284 |
| 8814 | of 1900 | United Kingdom | 405/284 |

*Primary Examiner*—Henry E. Raduazo

*Attorney, Agent, or Firm*—Robert D. Yeager; Christine R. Ethridge

[57] ABSTRACT

A cantilevered wall and foundation unit particularly useful for supporting a building constructed on a hillside includes cantilevered side walls and an inclined rear wall. The cantilevered side walls include a support section and a cantilevered section. The foundation unit can be constructed in place or, in part, at a location remote from the excavation area. The rear wall can be planar, can include a section having the shape of a portion of a sphere, or can include a series of steps. The sidewall can be used to underpin an existing structure.

10 Claims, 15 Drawing Figures

CANTILEVERED SUPPORT MEMBER AND FOUNDATION UNIT

CROSS REFERENCE TO RELATED APPLICATIONS

This is a continuation in-part of U.S. application Ser. No. 283,568, filed July 15, 1981 and now abandoned.

BACKGROUND OF THE INVENTION

1. Field of the Invention

The present invention relates generally to walls and building foundations and, more particularly, to a wall having a cantilevered section and a foundation unit incorporating such a wall for supporting a building.

2. Description of the Prior Art

Conventional building foundations include a floor section disposed on the horizontal surface of an excavation and vertical sidewalls adjoining the floor section supported by footers formed in the excavation. Although such conventional foundations are suitable for supporting a building constructed on a horizontal surface, there are several disadvantages associated with using such a foundation to support a building on a hillside. The uphill-vertical wall must resist the force exerted on the foundation by the hillside uphill from the foundation. Accordingly, the uphill-vertical wall must be thicker than it would have to be to support only the building constructed on the foundation. Moreover, the large force exerted by the hillside on the uphill-vertical wall makes it advantageous to minimize the size of the portion of the building located beneath the surface, thereby maximizing the size of the portion of the building exposed to the elements and in turn, the amount of exterior finishing materials needed to construct the building.

In underwater construction, it is known that a slight incline of the retaining wall portion of a foundation unit will help to distribute the multi-directional forces exerted against the unit. Judson U.S. Pat. No. 921,545 which issued on May 11, 1909 discloses a caisson for use in foundations in water. The caisson shown and described by the Judson patent is a box-like receptacle having a rear wall, a front wall and two opposing side walls. The side walls, shown only in a top plan view of the caisson, are not described. The rear wall is inclined slightly from the vertical and the front wall preferably lies in a plane parallel to the rear wall.

The structure described by the Judson patent is particularly adapted for use under water. The rear wall acts as a retaining wall. The material retained exerts a generally horizontal force in one direction against the rear wall. The water, which exerts a generally horizontal force in the opposite direction against the front wall, resists the opposing force of the retained material. A cap which is positioned over the caisson when it is in place, exerts a downward force.

The caisson is designed to permit it to be floated to the desired location. It is then filled with heavy material and capped for use. The heavy filling and the slight backwards incline of the rear wall help to evenly distribute the multi-directional forces exerted against the caisson by shifting the center of gravity rearwardly from the foot of the front wall. To accommodate the floatation requirement, the incline of the rear wall cannot be too great, thus the center of gravity cannot be shifted too far to the rear.

In hillside construction, the force exerted by the hillside is not resisted in part by an opposing force exerted by water. In addition, the downward force or weight bearing against the walls of a foundation by a building is greater than the force of the cap on the walls of the caisson in the Judson patent. In other words, a building weighs more than the cap. Thus, the requirements for the distribution of forces to provide a stable foundation are markedly different for land based construction. The foundation unit must itself resist the generally horizontal forces of the hillside and the downward force, or weight, of the building constructed on the foundation. The strength of the those forces, of course, varies depending upon the local soil conditions and the design of the building. Furthermore, because it is desirable to be able to use the space defined by the foundation, it is undesirable to fill that space with heavy material to stabilize the foundation. Anchors or piles have been used in some structures for stability.

Another problem too often associated with hillside construction is the failure of an older, existing foundation under a building or the subsidence of the ground support. To prevent damage to the building, the old foundation must be repaired or the subsidence corrected. Meanwhile, a temporary underpinning, usually beams—positioned under the building must be installed. When the soil under the beam is not stable, however, or when the building is constructed on or near the top edge of a hillside it is difficult to effectively place the underpinning. Furthermore, it may not be possible to correct the old foundation of the subsidence. There is a need, therefore, for a permanent underpinning for a building which can be used when conventional means of correction are not effective.

It is an object of the present invention to provide a foundation unit for land based construction that reduces the force exerted by a hillside. It is a further object of the present invention to provide a foundation that evenly distributes the forces exerted against it to provide a stable structure. It is another object of the present invention to provide a foundation which will increase the available living space of the building. Finally, it is an object of the present invention to provide a component of the foundation which can be used for underpinning an existing building when either lateral ground support erodes or the existing, older foundation fails.

SUMMARY OF THE INVENTION

The present invention provides a wall having a cantilevered section and a foundation unit incorporating such a wall for supporting a structure. Although the present invention is particularly advantageous when used to support a structure constructed on a hillside, the present invention can be used to support a structure constructed on any surface.

The wall having a cantilevered section of the present invention provides a device, or a support member, that can be used to underpin an existing structure or can be used as part of the foundation unit of the present invention. In the application of the present invention wherein the device, or support member, is used for underpinning a portion of an existing structure wherein the structure is positioned on an elevated surface and the device is adapted to be positioned on a lower horizontal surface, the device or support member, includes a base adapted to rest upon the horizontal surface, a wall adapted to lie in a vertical plane, the wall having a cantilevered section and a support section adjacent the cantilevered section. Such a device or support member can be used whether the structure rests on a level or inclined surface.

The cantilevered section is adapted to be so positioned beneath the portion of the structure that the portion rests upon, or is supported by, the cantilevered section when so positioned. The cantilevered section depends upon the support section to support the portion of the existing structure. That is, the support section is so associated with the cantilevered section that the weight of the structure, when the portion rests upon the cantilevered section, is shifted to and borne by the support section. The support section has a perimeter generally defined at least in part by a lower horizontal edge attached to the base, an upper edge, and a upwardly directed line extending through the vertical plane from about a first end of the lower horizontal edge to about an end of the upper edge. The cantilevered section is attached to the support section along the upwardly directed line and has a perimeter generally defined by that line, a top edge, a junction and an inclined edge. The top edge has a first end and a second end. The first end of the top edge of the cantilevered section is attached to the end of the upper edge of the support section. The inclined edge of the cantilevered section extends upwardly and outwardly at an obtuse angle relative to the lower horizontal edge of the support section from about the first end of the lower horizontal edge. A junction joins the second end of the top edge to the uppermost portion of the inclined edge and is adapted to be positioned beneath the portion of the structure to permit the portion to rest thereon.

The base may be integrally attached to the lower horizontal edge of the support section. Alternatively, the base may be a separate unit upon which the lower horizontal edge is mechanically attached. The cantilevered section and the support section likewise may be integrally attached or may be separate subunits adapted for mechanical attachment to each other along the upwardly directed line. At least one anchor may be attached to the base for penetrating the lower horizontal surface to anchor the device to the surface.

In the application of the present invention wherein the wall having the cantilevered section is incorporated into a foundation unit for supporting a structure thereon, and the foundation unit includes a rear wall and at least two opposing sidewalls adapted to lie in a vertical plane perpendicular to the horizontal surface upon which the foundation unit is constructed, the present invention provides an improvement in the sidewalls. Each sidewall is defined by the support section and the cantilevered section described above. The foundation unit may be constructed on a hillside, wherein the hillside is excavated to provide a flat or horizontal surface and an inclined surface. Alternatively, the foundation unit may be constructed on any horizontal, or level surface.

The foundation unit of the present invention can be either constructed in situ or prefabricated in part and placed within the excavation in any suitable fashion. Because the foundation unit is cantilevered, the cantilevered rear wall of the unit need not be supported by the surface on which the building is constructed.

The foundation unit includes a base, or footer, disposed within the excavation beneath the front wall and each sidewall, and a floor within an area enclosed by the walls above the horizontal surface. Preferably, the foundation unit also includes a resisting member, or a conventional T-section, secured to the sidewalls for resisting the force exerted on the foundation unit by the structure and, if the building is constructed on an inclined surface, by the earth located uphill from the structure, and at least one anchor secured to the bottom of the base and penetrating the surface of the excavation to prevent the foundation unit from shifting its position within the excavation.

Assuming the structure is constructed on a hillside, the hillside exerts a lesser force on the rear retaining wall of the present invention than would be exerted by the hillside on a substantially perpendicular retaining wall because the rear retaining wall of the foundation unit of the present invention is inclined. Accordingly, for a given application, the inclined rear retaining wall of the present invention need not be as thick or strong as need be a vertical retaining wall used in the same application and, accordingly, a cost savings in building materials necessary to construct the foundation is achieved through use of the present invention. Moreover, less exterior finish building materials can be used when a structure incorporating the foundation unit of the present invention is constructed than when a structure is constructed incorporating a conventional foundation because a greater proportion of the former type of building can be disposed within the hillside than the latter. Further, more living space is provided on the second floor of a structure incorporating the present invention than can be provided in structures mounted on conventional foundation having vertical retaining walls.

Although the rear wall of the foundation unit may be of many configurations, several configurations are particularly preferable. In one embodiment, the rear wall is simply a planar wall constructed of concrete and a reinforcing mesh. In another embodiment, the rear wall is constructed in step-like fashion so that the interior surface of the rear wall includes a series of steps. Moreover, in another embodiment, a section of the rear retaining wall has the shape of a portion of a sphere. Further, more than one foundation unit of the type described above can be joined together in the excavation to form a part of a larger foundation. Such a foundation can be formed by securing together several foundation units within the excavation.

The method of the present invention includes the steps of forming an excavation having a flat surface; forming a base or footer for the foundation unit within the excavation; securing a pair of vertical side walls or side support members to the base; constructing an inclined rear retaining wall and securing the inclined rear retaining wall to the vertical side walls; and constructing a floor section on the flat surface. The vertical side walls can be formed on the base or can be prefabricated at a location remote from the excavation area.

Accordingly, the present invention provides a wall having a cantilevered section and foundation unit incorporating such a wall for supporting a structure. The foundation unit can be constructed on a hillside and consumes less building material than conventional foundations and provides more living space than is provided by structures constructed on conventional foundations. The wall of the present invention provides a vertical support member, or device, that can be used to support, or underpin, an existing structure.

BRIEF DESCRIPTION OF THE DRAWINGS

The following detailed description of the preferred embodiments can be understood better if reference is made to the accompanying drawings in which.

DETAILED DESCRIPTION OF THE PREFERRED EMBODIMENTS

FIGS. 1 through 15 illustrate the preferred embodiments of the improved cantilevered side wall 16 and foundation 10 of the present invention.

Figure 11:
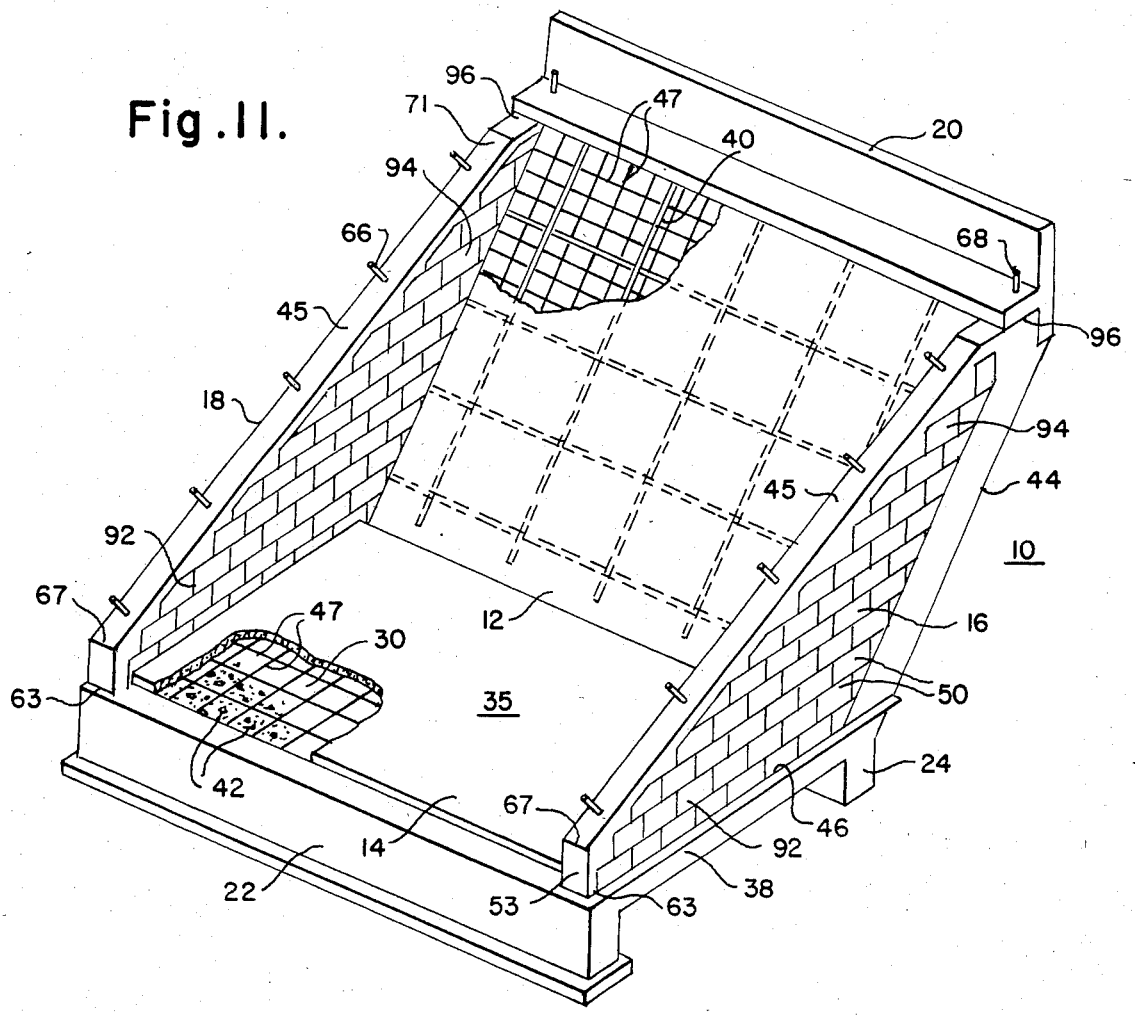
FIG. 11 is an isometric view of the foundation unit shown in FIG. 1.
Figure 8:
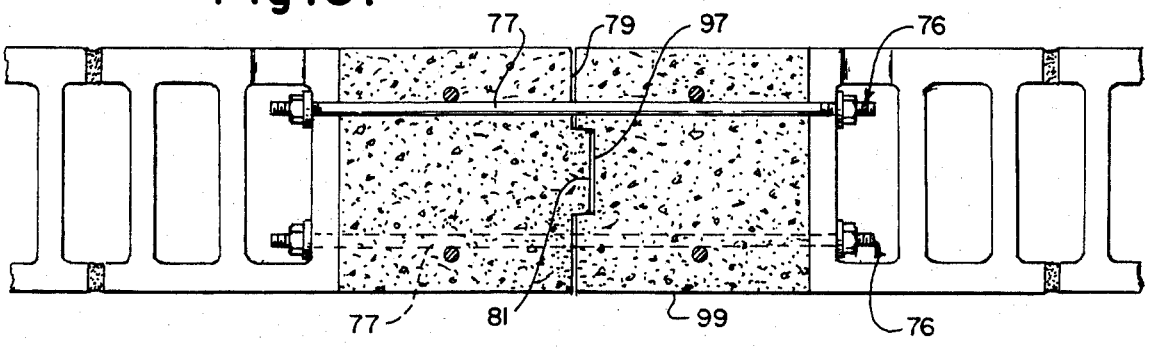
FIG. 8 is a view of the foundation unit shown in FIG. 7 taken along the line VIII—VIII.
Figure 9:
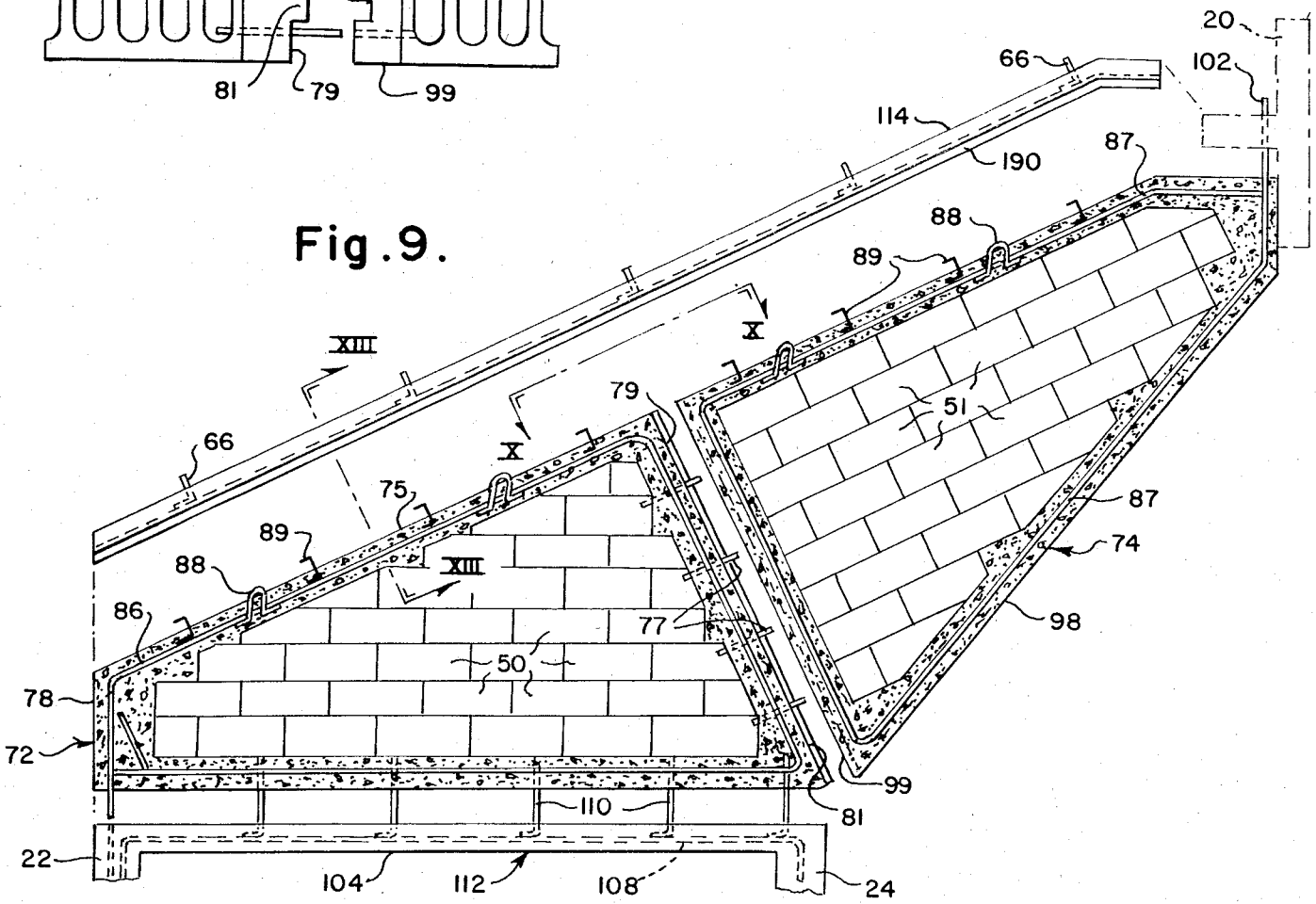
FIG. 9 is an exploded view of the foundation unit shown in FIGS. 7 and 8.
Figure 10:
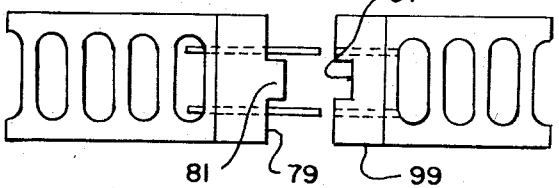
FIG. 10 is a view of a portion of the foundation unit shown in FIG. 9 taken along the line X—X.
Figure 13:
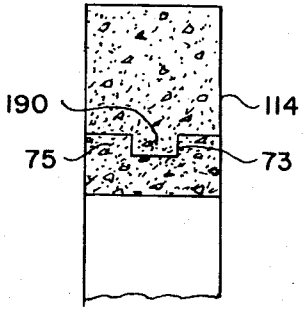
FIG. 13 is a view of the foundation unit shown in FIG. 9 taken along the line XIII-XIII.
Figure 14:
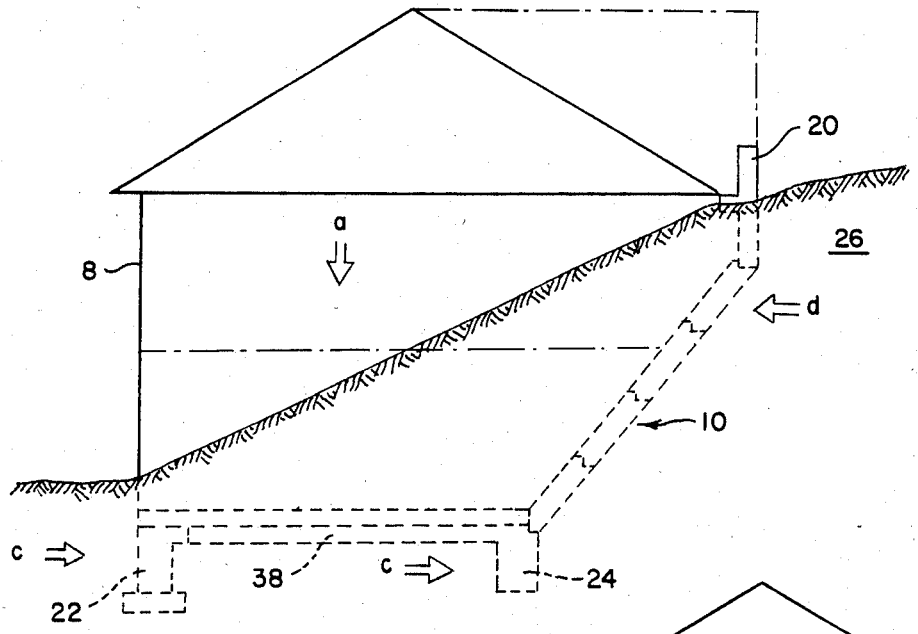
FIG. 14 is a side elevation view of the foundation unit with a structure constructed thereon.

FIG. 11 illustrates the foundation unit 10 and shows a rear inclined wall 12, two opposing side walls 16 and 18, base 38, floor 14, a resisting member 20, preferably in the form of a T-shaped section, a member 22 extending downwardly from base 38 and an anchor 24 extending downwardly from base 38. The member, or T-shaped section 20, member 22 and anchors 24 provide a three point arrangement for resisting the forces exerted against the foundation unit 10 to prevent foundation unit 10 from shifting within a hillside 26.

Figure 1:
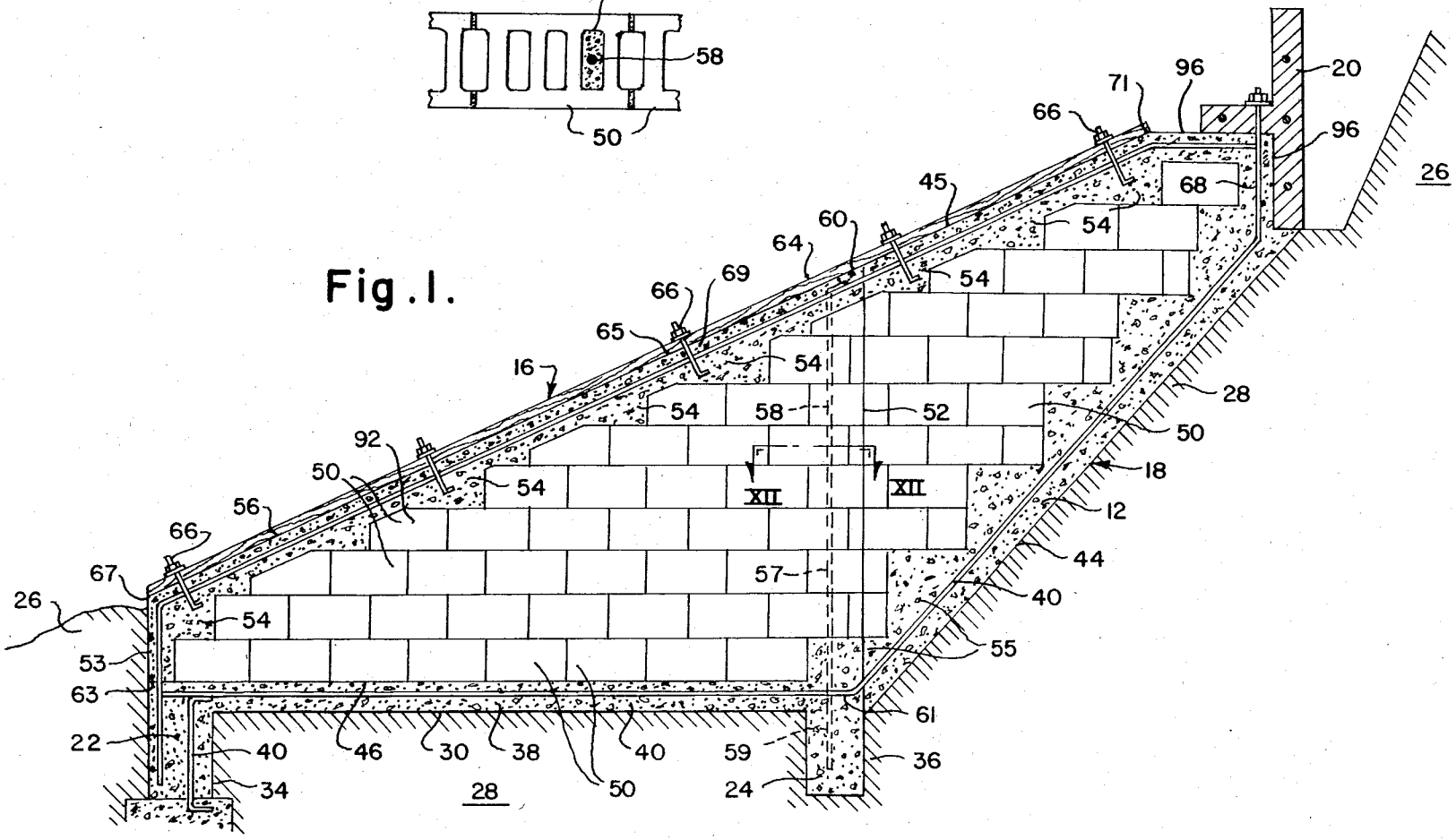
FIG. 1 is a side elevational view of the foundation unit constructed in situ according to the provisions of the present invention.
Figure 12:
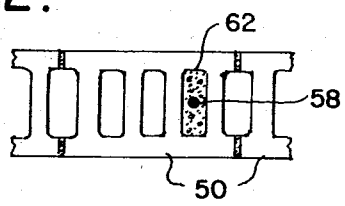
FIG. 12 is a view of the foundation unit shown in FIG. 1 taken along the line XII—XII.

Foundation unit 10 can be completely formed in place or prefabricated in part at a location remote from the construction site. Regardless, an excavation 28 is formed in hillside 26 to receive foundation unit 10. Referring to FIG. 1, hillside 26 is excavated to form horizontal surface 30, inclined surface 32, channel 34, anchor recesses 36 (only one shown) and a pair of side excavation surfaces (not shown). Channel 34 is dimensioned to receive member 22. Recesses 36 are dimensioned to receive anchors 36. The bottom surface of base 38 contacts and rests upon the horizontal surface 30. The horizontal surface 30 thus supports base 38 and consequently, side walls 16 and 18. Floor 14, as shown in FIG. 11, lies on horizontal surface 30 over gravel 42 in a generally horizontal plane substantially parallel to the plane of the horizontal surface 30 of excavation 28. Floor 14 is positioned between the walls of the foundation unit 10 over an area 35 enclosed within the walls 12, 16, 18, and a front wall (not shown). See FIGS. 2, 3, 4, 5, and 11.

Referring to FIG. 1, each side wall 16 or 18 lies in a vertical plane and is defined by a support section 92 and a cantilevered section 94. The perimeter of support section 92 is roughly defined at least in part by a lower horizontal edge 46, an upper edge 56 and a line 52 extending generally upwardly through the vertical plane of the side wall 16 or 18, from about a first end 61 of the lower horizontal edge 46 to about a first end 65 of the upper edge 56. In the sidewall 18 shown in FIG. 1, for example, a second end 63 of lower horizontal edge 46 is near a second end 67 of upper edge 56 because of the inclination of upper edge 56. It will be appreciated by those skilled in the art that the vertical portion 53 of the support section 92 between second end 63 and second end 67 may be any reasonable length and the upper edge 56 may assume any reasonable inclination, depending upon the proportions of the excavation, the slope of the hillside, if any, and design and material considerations.

Again referring to FIG. 1, the perimeter of the cantilevered section 94 is roughly defined by the upwardly directed line 52, an inclined edge 44, a junction 96 and a top edge 60. Top edge 60 includes a first end 69 and second end 71. The inclined edge 44 extends upwardly and outwardly at an obtuse angle relative to lower horizontal edge 46 from about the first end 61 of the lower horizontal edge 46. Junction 96 joins the uppermost portion of inclined edge 44 to the second end 71 of the top edge 60. The obtuse angle formed by inclined edge 44 relative to lower horizontal edge 46 must be sufficiently obtuse that the weight of the structure 8 resting on cantilevered section 94 when the structure 8 is constructed on foundation unit 10, is shifted to and borne by support section 92. Thus, cantilevered section 94 depends upon support section 92 to support the structure. Cantilevered section 94 also thereby permits an increase in the usable living space of structure 8 without a corresponding increase in the support section extending into the hillside.

First end 69 of top edge 60 adjoins first end 65 of upper edge 56 to define a top surface 45 of side wall 16 or 18. The top edge 60 of cantilevered section 94 as shown in FIG. 1, assumes the same inclination as upper edge 56, then levels off to form junction 96.

Figure 2:
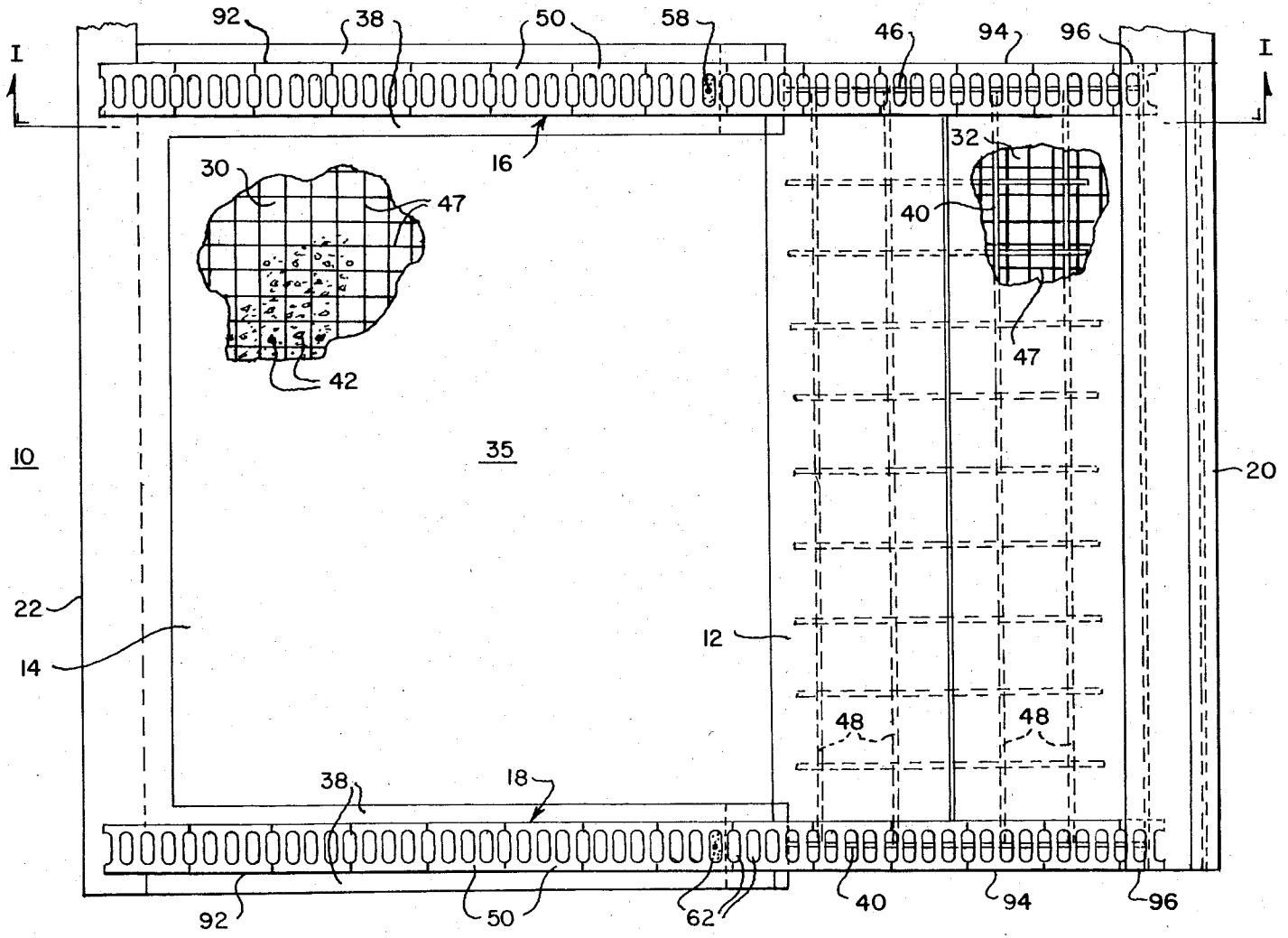
FIG. 2 is a top plan view, partly in section, of the foundation unit shown in FIG. 1.

The T-shaped section 20 is mounted on junction 96 of cantilevered section 94. Referring to FIGS. 2 and 11, T-shaped section 20 is mounted on the cantilevered section 94 and the rear wall 12 and extends from the junction 96 of side wall 16 to the junction 96 of the opposing side wall 18.

It will be appreciated by those skilled in the art that the above described rough perimeters of the support and cantilevered sections of the side walls 16 and 18 are for purposes of description. The sidewalls 16 and 18 are solid walls having a thickness as well as a perimeter in a vertical plane. FIGS. 2, 4, 6 and 11 illustrate the thickness of the preferred embodiments of the sidewalls 16 and 18. When support section 92 is integrally connected to cantilevered section 94, upwardly directed line 52 is an imaginary line. It is shown in FIG. 1 only to aid the description.

To construct the foundation unit 10, the excavation 28 is prepared as described above. Preferably, member 22, anchors 24, and base 38 are formed first.

Member 22, anchors 24, and base 38 are formed preferably from concrete reinforced with reinforcing bar 40. An extension rod 59 is inserted in the fresh concrete forming base 38 and each anchor 24. The area 35 enclosed by base 38 can be filled with gravel 42 or any other suitable drainage material.

Next sidewalls 16 and 18 are constructed by laying courses of cement blocks 50 on base 38 to the desired height and inclination of sidewalls 16 and 18. It can be seen in FIG. 2 that base 38 is wider than sidewalls 16 or 18. It is necessary to arrange the first few courses of each sidewall 16 and 18 to permit extension rod 59 to pass through openings 62 in concrete blocks 50 where necessary. Each time several courses of wall 16 or 18 are laid, concrete is poured into the openings in concrete blocks 50 around rod 59 to anchor it within wall 16 or 18. When a sufficient number of courses have been laid, rod 58 is inserted into openings 62 of block 50 until end 57 touches or overlaps rod 59. Again, each time several courses of wall 16 or 18 are laid, concrete is poured into openings 62 around rod 58 to secure rod 58 within wall 16 or 18. Rods 58 and 59 increase the stability of walls and 18. As courses of block 50 are laid, regions 55 are filled with concrete by pouring concrete into appropriately constructed forms (not shown) between inclined surface 32 and blocks 50. The forms permit the concrete to be poured so that regions 55 define the inclined edge 44 of cantilevered section 94. Reinforcing bar 40 is disposed on inclined surface 32 before any region 55 is poured. Ends 48 of reinforcing bar 40 protrude from side walls 16 and 18 and facilitate securing rear wall 12 to sidewall 16 and 18.

After courses of block 50 have been laid to the desired height of sidewalls 16 or 18, a tin cap (not shown) is placed into any exposed openings 62 of blocks 50 to close those openings. Region 54 is formed from concrete and reinforcing bar 40 by constructing a wooden form on sidewall 16 or 18 including plywood tie beam forms (not shown) and mud sill 64. The forms and mud sill 64 permit region 54 to be formed to define the upper edge 56 and the top edge 60 which together define top surface 45. Bolts 66 are passed through holes in mud sill 64 and disposed within region 54 before the concrete forming region 54 is poured to provide a mount for the rough frame of the building. The tie beam forms are removed from wall 16 or 18 after the concrete has hardened. Finally, T-section 20 is placed over the ends 68 of reinforcing bar 40 on junctions 96 of opposing side walls 16 and 18 and bolted in place.

After walls 16 and 18 are completed, rear wall 12 is formed on inclined surface 32 of excavation 28. Rear wall 12 which functions as a retaining wall when foundation unit 10 is constructed on a hillside, is formed from concrete reinforced with reinforcing bar 40 and wire mesh 47. Ends 48 of reinforcing bar 40 protrude from walls 16 and 18 into rear retaining wall 12 to anchor sidewalls 16 and 18 to rear retaining wall 12. Then floor 14 is formed. Floor 14 is made concrete and wire mesh 47. It is positioned over area 35 of which has been covered with gravel 42. Although not shown, those skilled in the art will recognize that any suitable known front wall is preferably also constructed to complete the foundation 10. Finally, referring to FIG. 14, the building, or structure 8, is constructed on walls 16 and 18 and T-section 20 of foundation unit 10 by any suitable known method of construction. Bolts 66 described above are provided to mount the rough frame of the structure 8 onto foundation unit 10. The chained lines represent the floor levels within the structure 8 and the possibility of extra stories. The arrows represent the forces. Arrow a is the weight of the structure 8. Arrow c is the resistance offered by the anchors 24 and member 22. Arrow d is the force of the hillside 26. It can be seen that a vertical rear wall and vertical edges on the sidewalls would limit the usable space or require the lower horizontal surface of the sidewalls to extend further into the hillside 26.

Figure 7:
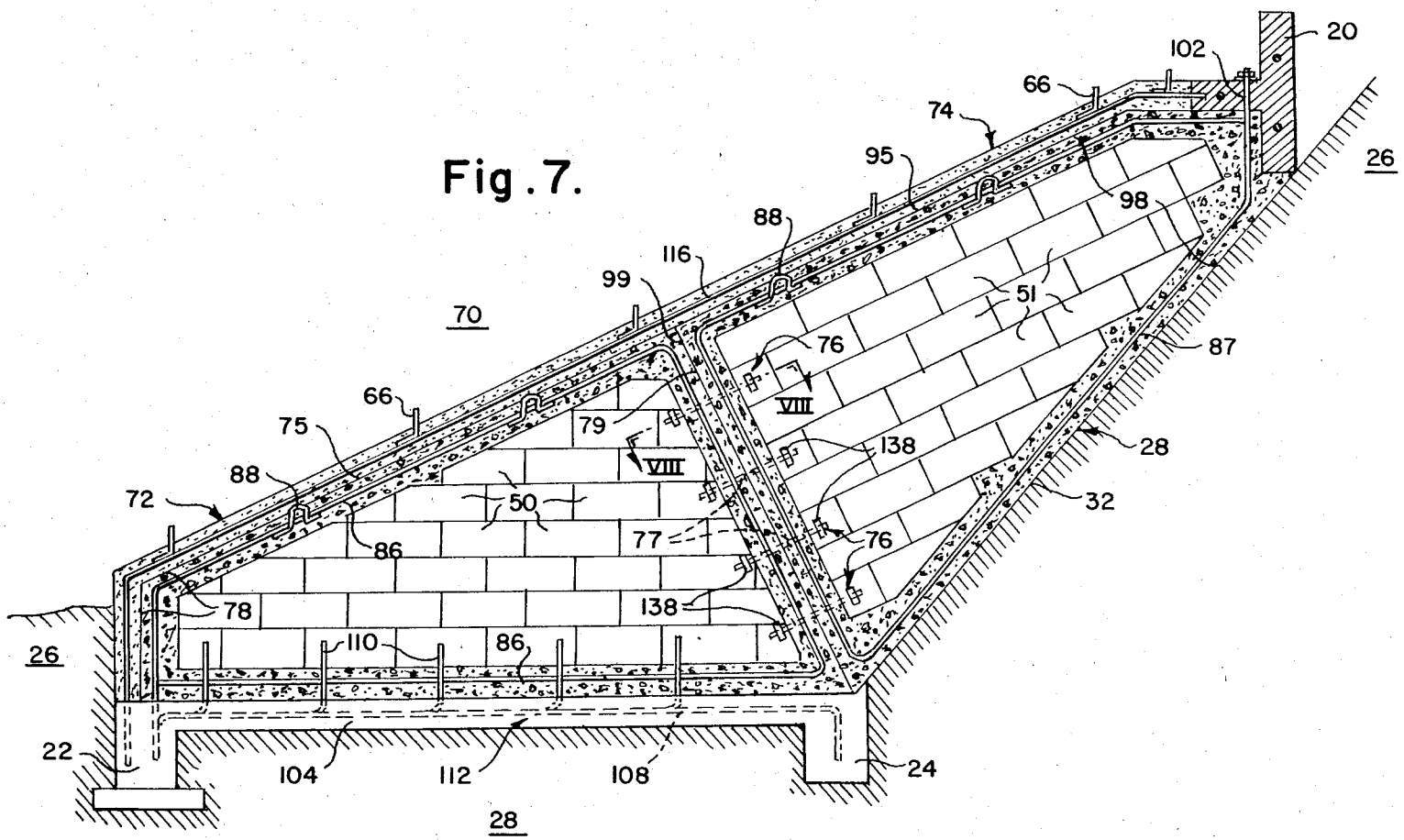
FIG. 7 is a side plan view, partly in section, of a foundation unit constructed according to the provisions of the present invention that is formed from two side wall subunits.

FIG. 7 shows in part the preferred embodiment of a partially prefabricated foundation unit 70 constructed according to the provisions of the present invention. Prefabricated unit 70 is particularly useful for supporting larger structures or forming larger foundations. Each sidewall of prefabricated unit 70 includes two sidewall support and cantilevered section subunits 72 and 74, respectively, bolted together with bolts 76. Preferably, sidewall support and cantilevered section subunits 72 and 74 are formed at a location remote from the building site. Subunit 72 corresponds to support section 92 and includes a perimeter, or frame 78, blocks 50, and reinforcing bar 86. Edge 79 of frame 78 includes key 81 (shown in FIGS. 9 and 10) to facilitate alignment of frame 78 with frame 98 of cantilevered subunit 74. Edge 79 forms a line through the vertical plane in which the sidewalls 16 and 18 lie. Upper edge 75 of frame 78 which corresponds to upper edge 56 of the perimeter of support section 92, includes keyway 73 (shown in FIG. 13) to facilitate securing cap 114 to frame 78. Cap 114 includes a key 190 to fit into keyway 73. Support subunit 72 is formed horizontally by constructing forms defining the shape or perimeter, of frame 78 on a flat horizontal surface and then constructing the wall portion of unit 72 within the form. The form and blocks 50 define frame 78. Reinforcing bar 86 is placed within the region defined by the forms and blocks 50, the exposed openings of block 50 are closed with tin caps, and concrete is disposed between blocks 50 and the form. Shanks 77 of bolts 76 are inserted into frame 78 before the concrete forming it hardens. Hooks 88, formed from reinforcing bar, are set in the concrete of frame 78 before it sets to facilitate lifting and handling of support subunit 72. Securing members 89, made of metal rod, are also placed in frame 78 before the concrete forming it hardens. Securing members 89 facilitate securing cap 114 to frames 78 and 98.

Cantilevered subunit 74 corresponds to cantilevered section 94 and includes frame 98, blocks 51 and reinforcing bar 87. Line 99 of frame 98 includes a keyway 97 (shown in FIG. 10) that mates with key 81 of frame 78 to facilitate alignment of frame 78 with frame 98. Top edge 95 of frame 98 which corresponds to top edge 60 of cantilevered section 94 includes a keyway (not shown) identical to keyway 73 to receive key 190 to facilitate securing cap 114 to frame 98. Cantilevered subunit 74 can be constructed in the same manner as support subunit 72. End 102 of reinforcing bar 87 protrudes from frame 98 at an area equivalent to junction 96 to facilitate mounting a T-section 20 to cantilevered subunit 74. Holes are drilled in frame 98 along line 99—or are formed when frame 98 is formed—to receive shanks 77 of frame 78.

Partially prefabricated foundation unit 70 is constructed within excavation 28 as follows. A base 112 comprising member 22 and anchors 24 (only one shown), and base section 104, is formed in excavation 28 with concrete and reinforcing bar 108. Extensions 110 protrude from base 112 to facilitate securing support subunit 72 to base 112. After the concrete forming base 112 hardens, a crane engages hooks 88 of subunit 72 and lowers subunit 72 onto base 112 so that extension 110 pass through holes drilled in the lower horizontal edge of support subunit 72. Extensions 110 are secured in any suitable fashion to support subunit 72. Then the crane engages hooks 88 of cantilevered subunit 74 and lowers cantilevered subunit 74 into place onto support subunit 72 and inclined surface 32 of excavation 28. Holes are drilled in blocks 51 proximate the threaded end of shafts 77 and nuts 138 are threaded onto the ends of bolts 76 to join together frames 78 and 98. The holes can be filled with concrete after frames 78 and 98 have been bolted together. T-section 20 is formed in place over end 102 of reinforcing bar 87 in any suitable fashion. Alternately, a preformed T-section 20 is place over end 102 and secured to it in any suitable fashion. Cap 114 is formed in place on frames 78 and 98 from concrete and reinforcing bar 116 in the same manner as region 54 is formed for foundation unit 10 described above. The floor 14 and rear wall 12 of partially prefabricated foundation unit 70 can be formed in the same manner as they are formed for foundation unit 10.

Figure 3:
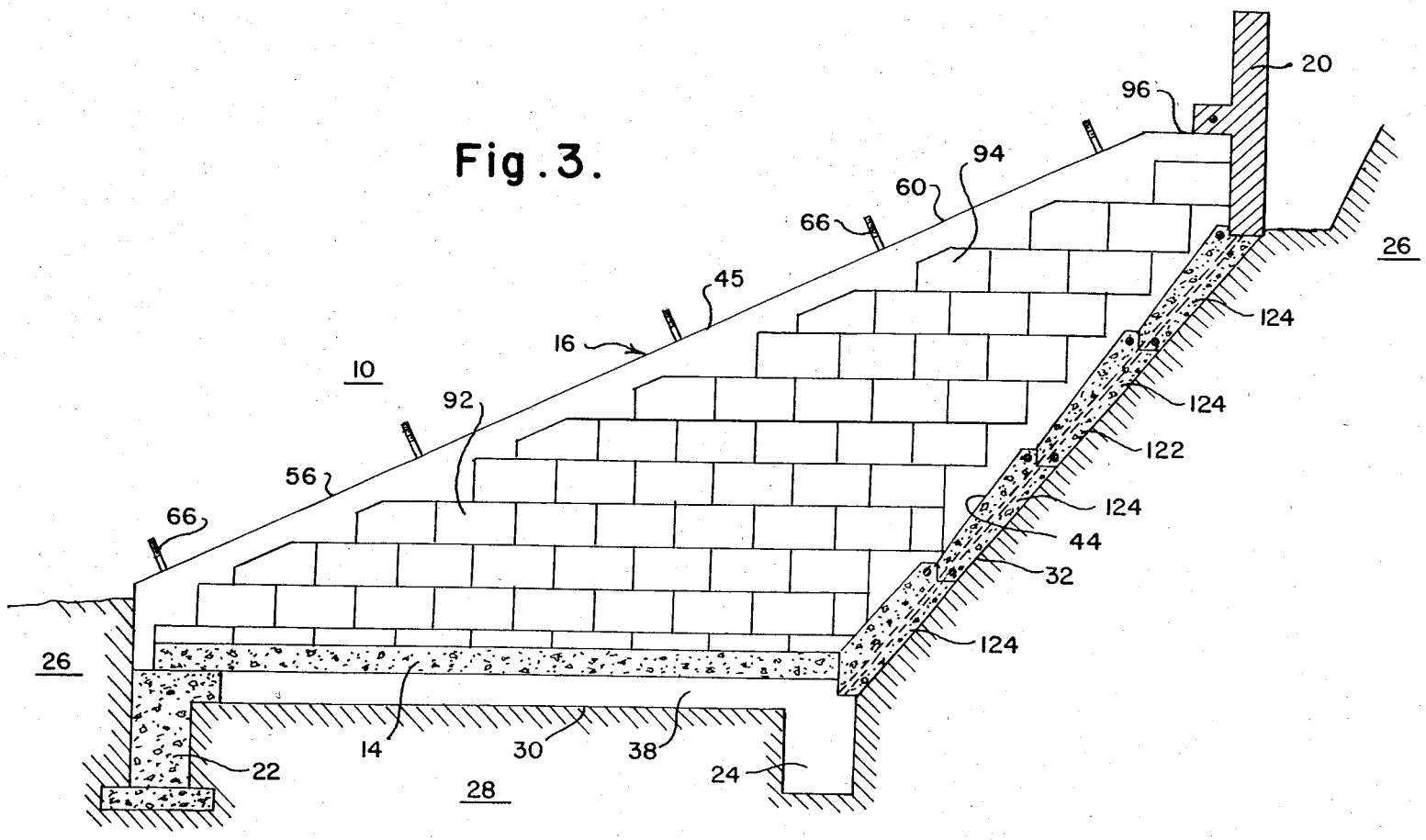
FIG. 3 is a side elevational view, partly in section, of a foundation unit constructed according to the provisions of the present invention having a stepped retaining wall.
Figure 4:
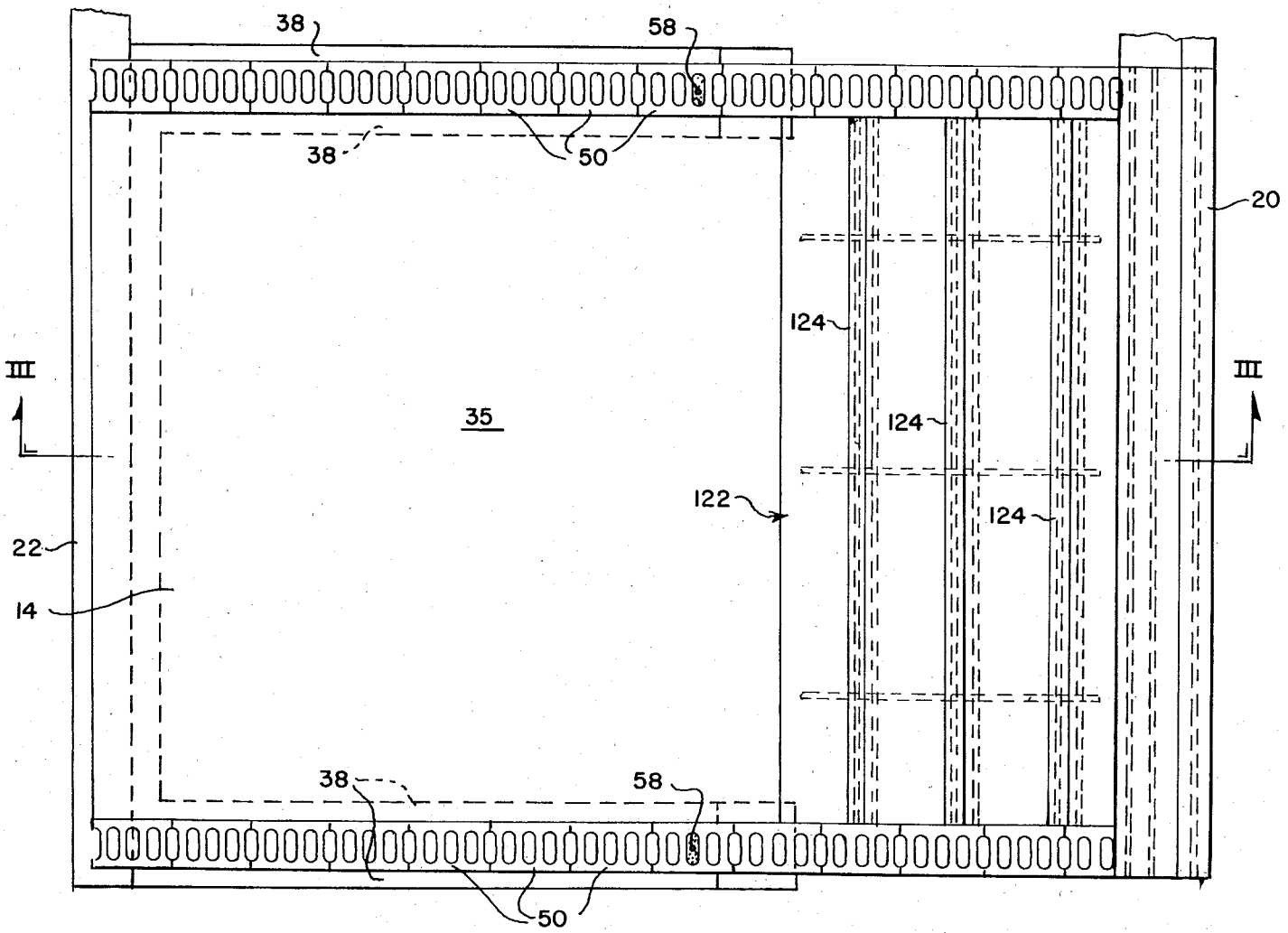
FIG. 4 is a top plan view, partially in section, of the foundation unit shown in FIG. 3.

FIGS. 3 and 4 show an alternate embodiment of a stepped rear wall 122. The steps 124 of stepped rear wall 122 are formed one at a time starting at the bottom of the rear wall. Alternately, the entire stepped rear wall 122 can be poured at one time.

Figure 5:
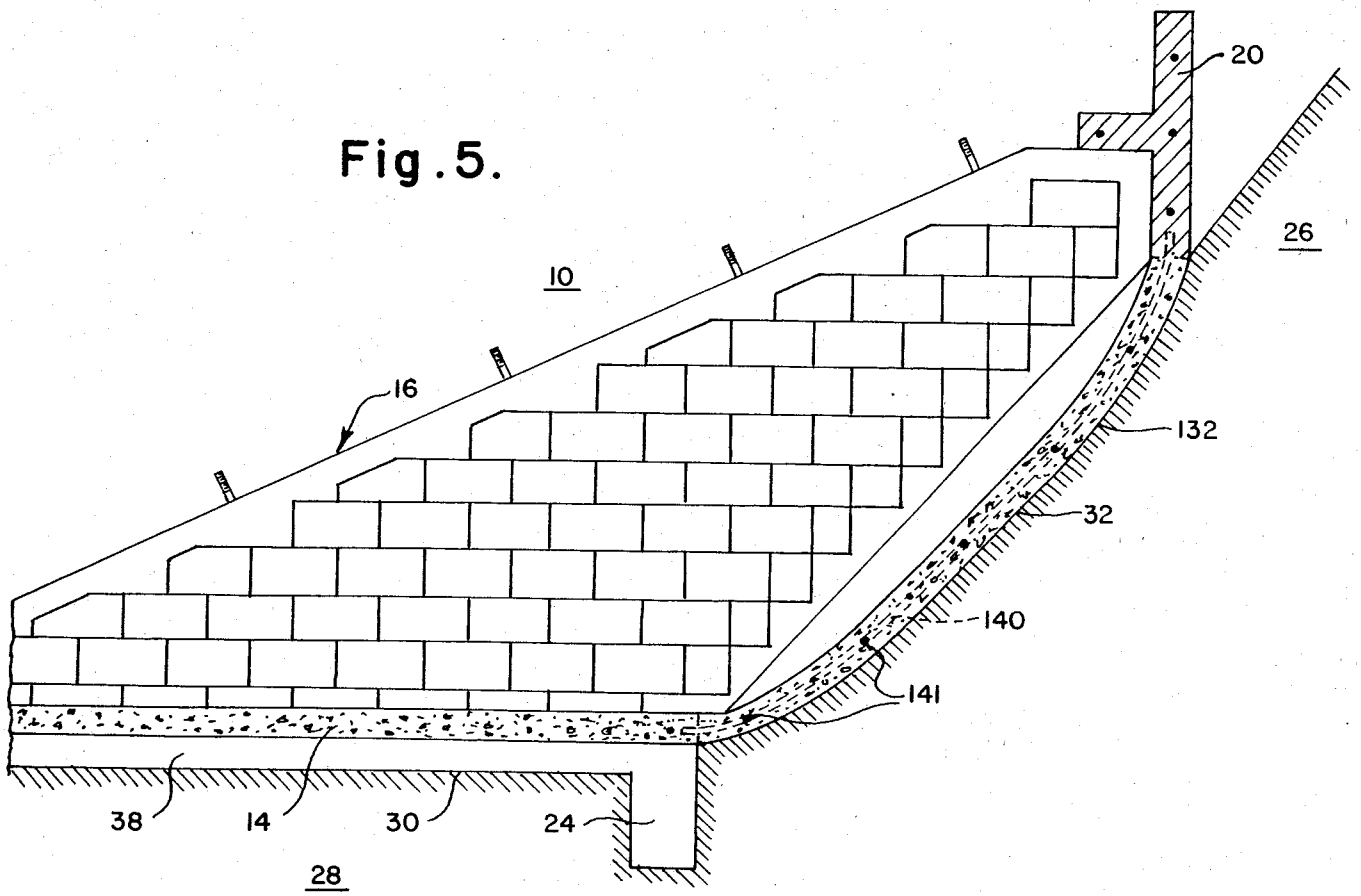
FIG. 5 is a side elevational view, partly in section, of a portion of a foundation unit constructed according to the provisions of the present invention, having a retaining wall with a section that is partly spherical in shape.
Figure 6:
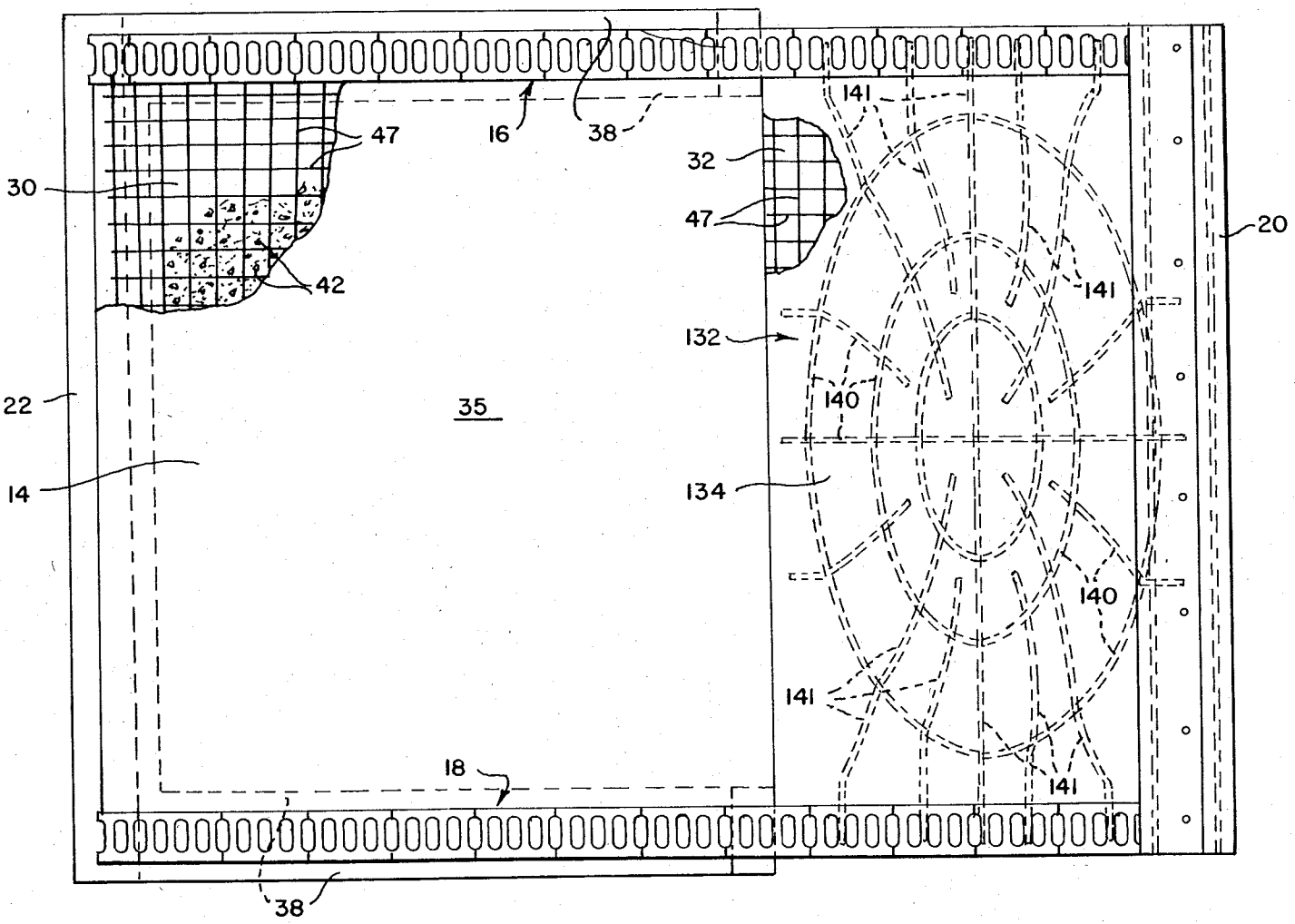
FIG. 6 is a top plan view, partly in section, of the foundation unit shown in FIG. 5.

FIGS. 5 and 6 shown a portion of another embodiment of a rear wall 132 with a section 134 that has the shape of a portion of a sphere. The rear wall 132 is preferably formed by spraying concrete against inclined surface 32 and reinforcing bar 140 and 141 and mesh 47. One end of each reinforcing member 141 should be secured to sidewalls 16 or 18 as shown in FIG. 6.

It should be noted that any number of foundation units 10 or 70 can be arranged in a variety of configurations within an excavation whether formed in a hillside or on a level surface, to form foundations larger than a single foundation unit. Also, when the foundation unit is used to support relatively large structures, the concrete disposed around the concrete block in the vertical walls can be pretensioned, as is generally known in the art. Further, when the foundation unit is used to support a structure on a hillside, any generally known anchoring technique can be employed to prevent the foundation unit from moving in the hillside. The three point resisting arrangement shown by the present invention is preferred.

Figure 15:
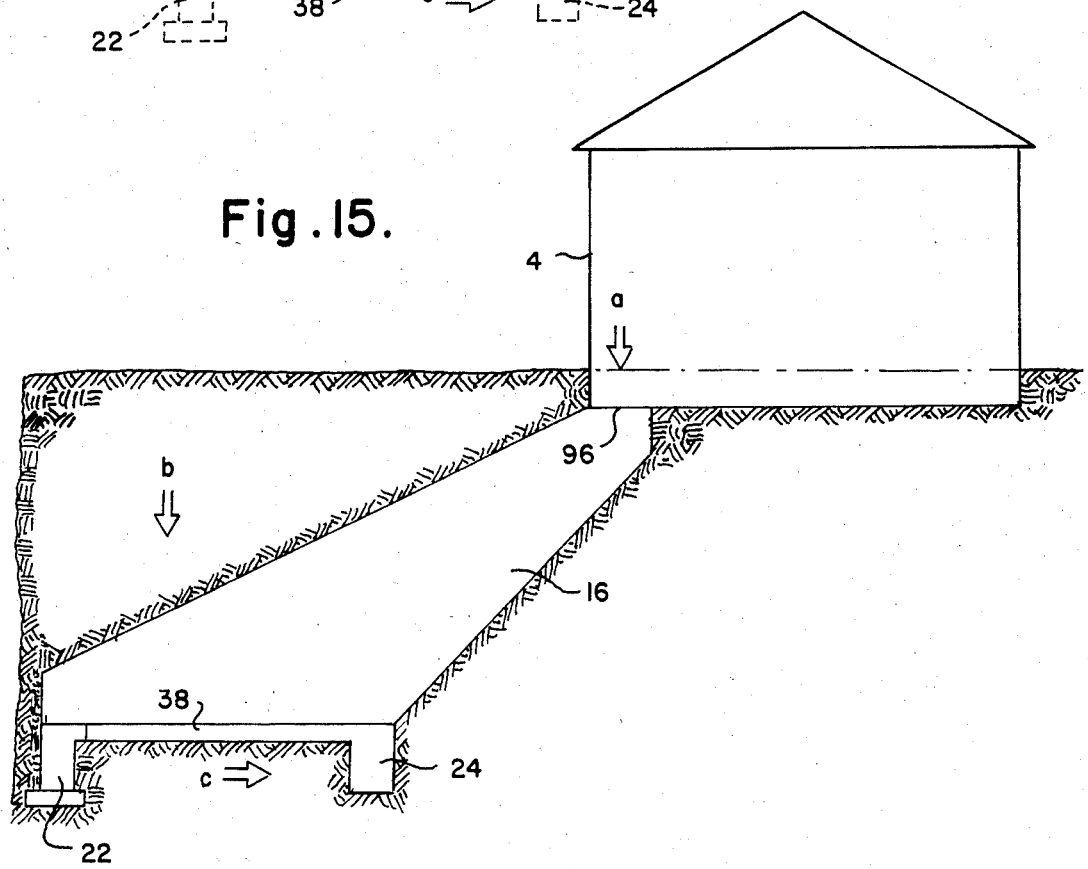
FIG. 15 is a side elevation view of the device or support member of the present invention underpinning a portion of an existing structure.

In the embodiment of the present invention used to underpin an existing structure 4, one support member equivalent to a sidewall 16 or 18 may be used. Referring to FIG. 15, the junction 96 of the cantilevered section 94 is positioned beneath a portion 6 of the existing structure 4 in a ditch dug near the structure 4 so that that portion 6 rests on the cantilevered section 94. The weight of the structure is shifted to and borne by the support section 92 which rests on base 38. Base 38 rests on the lower elevation in the ditch. The arrows represent the forces. Arrow a is the weight of the structure on the cantilevered section 94 of the wall 16. Arrow b is the weight of the earth. Arrow c is the resistance offered by the anchor 24 and member 22.

The base 38 may be integrally connected to the support section 92, for example, when the cement blocks 50 forming support section 92 are placed on the wet concrete forming base 38. Alternatively, the base 38 may be separate and the support section 92 may be mechanically joined to the base 38 by any suitable means, such as the extensions 110 described above with respect to base 112 and prefabricated support subunit 72.

What is claimed is:

1. In a foundation unit constructed on a hillside for supporting a structure thereon, wherein said hillside is excavated to provide a horizontal surface and an inclined surface, and wherein said foundation unit is constructed on said horizontal surface and includes a floor, a rear wall confronting said inclined surface, a front wall and at least two opposing side walls adapted to lie in a vertical plane perpendicular to said horizontal surface, the improvement in each of said side walls comprising;

said side wall being defined by a support section and a cantilevered section;

said support section having a perimeter generally defined at least in part by a lower horizontal edge parallel to said horizontal surface, an upper edge and an upwardly directed line, said lower horizontal edge having a first end and a second end, said upwardly directed line extending through said vertical plane from about said first end of said lower horizontal edge to about an end of said upper edge;

said cantilevered section being attached to said support section along said upwardly directed line and having a perimeter generally defined by said upwardly directed line, a top edge having a first end and a second end, an inclined edge extending upwardly and outwardly at an obtuse angle relative to said lower horizontal edge from about said first end of said lower horizontal edge, and a junction joining said second end of said top edge to the upper most porton of said inclined edge, said first end of said top edge being attached to said end of said upper edge of said support section, said support section and said cantilevered section being preformed subunits adapted for attachment to each other along said upwardly directed line;

said upper edge and said to edge defining a top surface of said wall, said top surface being adapted to abut said structure when said structure is constructed on said foundation unit; and said obutse angle of said inclined edge of said cantilevered section being sufficiently obtuse that when said structure is constructed on said foundation unit the weight of said structure bearing against said cantilevered section is shifted to and borne by said support section, said cantilevered section permitting an increase in the usable space of said structure without requiring a corresponding increase in said lower horizontal edge of said side wall extenidng into said hillside.

2. An improvement as recited in claim 1 further comprising;

a base adapted to rest upon said horizontal surface beneath said horizontal lower edge of said support section, said horizontal lower edge being attached to said base.

3. An improvement as recited in claim 2 wherein said base is integrally attached to said support section.

4. An improvement as recited in claim 2 further comprising at least one anchor extending downwardly from said base penetrating said horizontal surface to anchor said foundation unit to said hillside.

5. An improvement as recited in claim 4 wherein said anchor extends from said base generally below said first end of said lower horizontal edge.

6. An improvement as recited in claim 5 further comprising a member extending downwardly from said base to penetrate said horizontal surface to anchor said foundation unit to said hillside, said member extending generally below said second end of said lower horizontal surface.

7. An improvement as recited in claim 6 further comprising a resisting member mounted on each of said cantilevered sections of said opposing sidewalls and said rear wall and extending from said junction of said cantilevered section of one of said at least two side walls to said junction of said cantilevered section of the other of said at least two side walls, said resisting member being adapted to further resist the force exerted on said foundation unit by said hillside and said structure, said anchor, said member and said resisting member forming a three point arrangement for resisting the forces exerted against said foundation unit.

8. An improvement as recited in claim 1 wherein said support section is integrally attached to said cantilevered section.

9. In a foundation unit for supporting a structure thereon, wherein said foundation unit is constructed on a horizontal surface and ahs a rear wall and a front wall, the improvement comprising:

at least two opposing side walls, each of said sidewalls adapted to lie in a vertical plane perpendicular to said horizontal surface;

each sidewall being defined by a support section and a cantilevered section, said support section and said cantilevered section being prefabricated subunits;

said support section having a lower horizontal edge substantially parallel to said horizontal surface and an upper edge;

said cantilevered section being attached to said support section along an upwardly directed line extending through said vertical plane from said lower horizontal edge to said upper edge, said cantilevered section having a top edge and an inclined edge extending upwardly and outwardly at an obtuse angle relative to said lower horizontal edge from one end of said lower horizontal edge;

said top edge adjoining said upper edge, said top edge and said upper edge defining a top surface of said side wall, said top surface being adapted to abut said structure when said structure is constructed on said foundation unit; and said obtuse angle of said inclined edge of said cantilevered sectin being sufficiently obtuse that when said structure is constructed on said foundation unit the weight of said structure bearing against said cantilevered section is shifted to and borne by said support section, said cantilevered section permitting an increase in the usable space of said structure without requiring a corresponding increase in said lower horizontal edge of said side wall.

10. An improvement as recited in claim 9 further comprising:

a base disposed on said horizontal surface beneath said opposing side walls;

at least one anchor extending downwardly from said base to penetrate said horizontal surface to anchor said foundation unit therein; and a floor disposed between said opposing sidewalls above said horizontal surface on a plane substantially parallel to the plane of said horizontal surface.

* * * * *

UNITED STATES PATENT AND TRADEMARK OFFICE

CERTIFICATE OF CORRECTION

PATENT NO. : 4,594,825

DATED : June 17, 1986

INVENTOR(S) : Guy M. Lamarca

It is certified that error appears in the above—identified patent and that said Letters Patent is hereby corrected as shown below:

Col. 11, line 36, delete "ahs" and substitute therefor --has--; and

Col. 12, line 21, delete "sectin" and substitute therefor --section--.

Signed and Sealed this

Second Day of December, 1986

*Attest:*

DONALD J. QUIGG

*Attesting Officer*

*Commissioner of Patents and Trademarks*